United States Patent [19]

Tsuda et al.

[11] Patent Number: 4,725,807

[45] Date of Patent: Feb. 16, 1988

[54] NONLINEAR VOLTAGE RESISTOR

[75] Inventors: Koichi Tsuda; Kazuo Mukae; Shigenori Takayasu, all of Kanagawa, Japan

[73] Assignee: Fuji Electric Co., Ltd., Kanagawa, Japan

[21] Appl. No.: 841,439

[22] Filed: Mar. 19, 1986

[30] Foreign Application Priority Data

Mar. 20, 1985 [JP] Japan ..... 60-57001

[51] Int. Cl.[4] ..... H01C 7/10

[52] U.S. Cl. ..... 338/20; 252/517; 264/104

[58] Field of Search ..... 338/20, 21; 252/512-521; 264/104, 61

[56] References Cited

U.S. PATENT DOCUMENTS 3,928,242 12/1975 May ..... 338/20 X
4,169,071 9/1979 Eda et al. ..... 338/21 X
4,319,215 3/1982 Yamazaki et al. ..... 338/20
4,386,022 5/1983 Nagasawa et al. .
4,452,729 6/1984 Carlson et al. ..... 338/20 X
4,460,497 7/1984 Gupta et al. ..... 338/20 X

FOREIGN PATENT DOCUMENTS 55-37846 9/1980 Japan .

*Primary Examiner*—E. A. Goldberg
*Assistant Examiner*—M. M. Lateef
*Attorney, Agent, or Firm*—Finnegan, Henderson, Farabow, Garrett, and Dunner

[57] ABSTRACT

A nonlinear voltage resistor is formed by sintering a resistor body made from a powder predominantly comprising ZnO. The powder also includes a first element selected from the group of Li and Na and a second element selected from the group of Al, In, and Ga. The powder preferably includes 50 to 1,000 atomic ppm of the first element and a concentration of the second element sufficient to set the carrier concentration of the powder in the range of 5 atomic ppm to 120 atomic ppm.

11 Claims, 7 Drawing Figures

NONLINEAR VOLTAGE RESISTOR

FIELD OF THE INVENTION

This invention relates to a nonlinear voltage resistor, and more particularly to a nonlinear voltage resistor formed of a sintered article having zinc oxide (ZnO) as a main component and intended to be used as a protective element against overvoltage.

BACKGROUND OF THE INVENTION

Heretofore for the purpose of protecting electronic devices and electric devices against damage due to overvoltage, there have been utilized nonlinear voltage resistors using silicon carbide (SiC), selenium (Se), and silicon (Si). In recent years, a nonlinear voltage resistor (hereinafter referred to as a "ZnO varistor") has made of a sintered article produced by admixing ZnO as a main component with various additives, molding the resultant mixture into a prescribed shape, and sintering the molded mixture. The ZnO varistor has characteristics such as a low discharge voltage and a large nonlinear voltage coefficient. It is, therefore, useful for protecting against overvoltage devices made up of semiconductor elements that have small capacities for resistance to overvoltage. The popularity of the ZnO varistor has been growing as a replacement for a SiC varistor and other overvoltage protection devices.

Among the types of ZnO varistors so far adopted for actual use is counted the ZnO-$Pr_6O_{11}$ type. It is known that the ZnO-$Pr_6O_{11}$ type varistor is produced by admixing ZnO as a main component with cobalt (Co), magnesium (Mg), calcium (Ca), potassium (K), and chromium (Cr) beside Pr as auxiliary components used in the form of elements or compounds and firing the resultant mixture. This is described in Japanese Patent Publication No. SHO 57(1982)-42,962.

The ZnO varistor is well known as a semiconductor ceramic and has electrical properties that are notably altered by the presence of a minute amount of impurities. When a monovalent metal such as sodium (Na) or lithium (Li) is added, the ZnO varistor increases its magnitude of resistance because the added metal functions as an acceptor. When a trivalent metal such as aluminum (Al) or iron (Fe) is added, the ZnO varistor loses its magnitude of resistance because the added metal functions as a donor. As demonstrated in Japanese Patent Publication No. SHO 55(1980)-37,846, Al is known to be an element capable of improving the discharge voltage property at a very low addition rate. Among the trivalent metals, Fe is a problematic element because this element, even at a very low addition rate, increases leakage current and deteriorates the discharge voltage property.

Since the ZnO varistor has its properties altered by impurities as described above, the compound ZnO used as the raw material therefore must be highly pure. Ordinary grade ZnO powder used as a white pigment is not acceptable.

The ZnO powder that is used for the ZnO varistor is mostly produced by the "France Method" that comprised fusing metallic Zn in a kettle made of carbon, for example, and oxidizing the Zn vapor issuing from the molten Zn with air. By this method, ZnO powder of extremely high purity can be produced. The kettle for the fusion of the metallic Zn is used for a long time and, therefore it produces a sediment of impurities. This sediment contains Fe in a large proportion. As a result, the proportion of Fe sediment that passes into the Zn vapor increases with the increasing number of days of use of the kettle. The Fe content of the produced ZnO powder, therefore, gradually increased with the increasing number of days of use of the kettle from an initial level of 2 atomic ppm to a level about 15 atomic ppm.

The varying Fe content of the ZnO powder from one lot to another of the raw material increased the possibility that the V-I property of the ZnO varistor will vary from one lot to another of the ZnO raw material. The conventional method has not always been capable of providing elements with stable properties.

OBJECTS AND SUMMARY OF THE INVENTION

An object of the present invention is a ZnO varistor that may be produced with consistent V-I properties.

Another object of the present invention is a ZnO varistor that is compensated for the present of Fe impurities.

A further object of the present invention is an improved method for forming ZnO varistors.

These and other objects are obtained by a nonlinear voltage resistor comprising a sintered article having a nonlinear voltyage drop over a range of currents passing therethrough, the article having formed of a sintered powder predominantly comprising zinc oxide and including a first element selected from the group of Li and Na and a second element selected from the group of Al, In, and Ga.

BRIEF DESCRIPTION OF THE DRAWINGS

The manner by which the above objects and other objects, features, and advantages of the present invention are attained will become fully apparent when the following detailed description is considered in view of the drawings, wherein.

A)/V(1 mA), obtained for varistors formed from raw ZnO material obtained by adding 100 atomic ppm of Li and 230 atomic ppm of In where the raw ZnO material varies in the number of days after production by the France Method.

DETAILED DESCRIPTION

Figure 1:
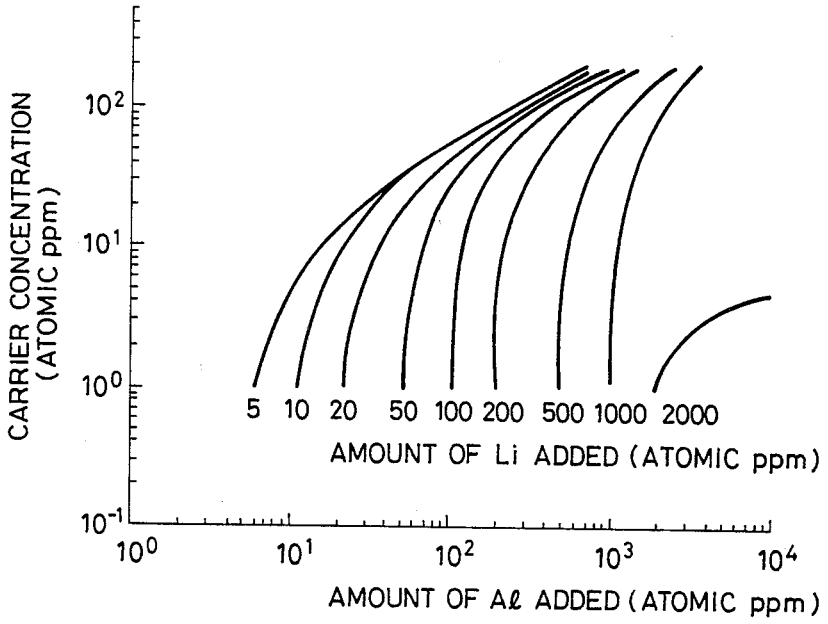
FIG. 1 is a graph showing the change of carrier concentration of the raw ZnO material due to different amounts of Al added for a varying Li concentration.

The present invention is directed to alleviating the effect of Fe entrained in ZnO thereby permitting production of a ZnO varistor exhibiting a satisfactory V-I property from a low current region through a high current region. This is accomplished by adding to the ZnO powder at least one element selected from the group of Na and Li in an amount necessary for counteracting the adverse effects of any Fe that may be mixed with the ZnO powder and, at the same time, adding at least one element selected from the group of Al, In, and Ga in an amount corresponding to the amount of Na or Li to be added.

When the ZnO powder as the raw material for the varistor has incorporated in advance at least one element selected from the group of Na and Li in an amount several times the amount of the Fe that is suspected to be mingled with the raw material, the Na or Li functions as an acceptor in contrast to the Fe that functions as a donor. The effects of the Fe are in this way counteracted. After the effect of the Fe has been eliminated as described above, the addition of at least one element selected from the group of Al, In, and Ga in an amount appropriate for the improvement of discharge voltage property and level of surge resistance permits production of a ZnO varistor having stable properties not affected by Fe that may be entrained in the ZnO powder as the raw material.

The present invention will be described more specifically with reference to the following examples.

(Example 1):

In a ball mill, a powder prepared by adding to ZnO powder 0.5 atomic % of Pr, 2.0 atomic % of Co, 0.2 atomic % of K, 0.15 atomic % of Cr, 0.1 atomic % of Mg, and 0.1 atomic % of Ca invariably in the form of oxides was mixed with aqueous solutions of Li and Al. The resultant wet mixture was dried and then calcined at 500° to 1,000° C. for several hours. The calcination product was thoroughly comminuted, combined with a binder, compression molded in the shape of a circular plate 17 mm in diameter, and fired in air at 1,100° to 1,400° C. for several hours to produce a sintered article. The sintered article so produced was ground to produce a test piece 1 mm in thickness. An element was prepared by baking electrodes to the opposite sides of the test piece and the element was tested for electrical properties. The ZnO powder used as the raw material had the purity of a guaranteed reagent and had Fe, Li, and Na contents of not more than 1 atomic ppm.

The electrical properties determined by the test were a voltage, V(1 mA), produced between the electrodes of a sample element when an electric current of 1 mA was passed therethrough at room temperature, a nonlinear voltage coefficient, $\alpha$, determined at a current in the range of 10 $\mu$A to 1 mA, the ratio, V(40 A)/V(1 mA), of the voltages between the electrodes which were measured when electric currents of 40 A and 1 mA, respectively were passed with a standard waveform of $8\times20$ $\mu$s through the element.

The nonlinear voltage coefficient, $\alpha$, was found by approximating the change of the current I of the element relative to the voltage according to the following formula:

$$I=KV^{\alpha} \quad (1)$$

wherein K denotes a constant to be determined by the element. The results are shown in Table 1.

The samples of the compositions shown in Table 1 were tested for carrier concentration by the C-V method. The results are shown in FIG. 1. The C-V method is intended to find carrier concentration and other factors of a given ZnO varistor based on the relation between the capacitance (C) and the voltage (V). It is well known as a method for the evaluation of physical properties of Si and other semiconductors. By a careful study of the relation between the carrier concentration and the V-I property, it was found that the nonlinear voltage coefficient, $\alpha$, was large and the discharge voltage property was satisfactory so long as the carrier concentration was in the range of 5 atomic ppm to 120 atomic ppm, without reference to the amounts of Li and Al added. It is noted from Table 1 that the compensation by Al was not effected satisfactorily and the V-I property was inferior when the amount of Li added exceeded 2,000 atomic ppm.

Figure 2:
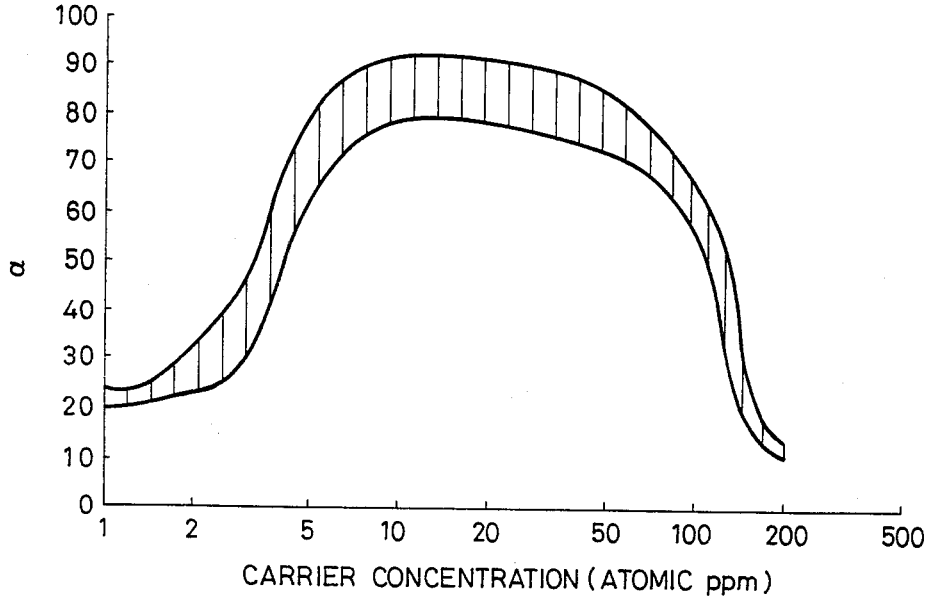
FIG. 2 is a graph showing the relation between the carrier concentration of the raw ZnO material and a nonlinear voltage coefficient, $\alpha$, obtained at the combinations of Li and Al concentrations of Table 1 wherein the Li concentration is in the range of 5 to 1,000 atomic ppm.
Figure 3:
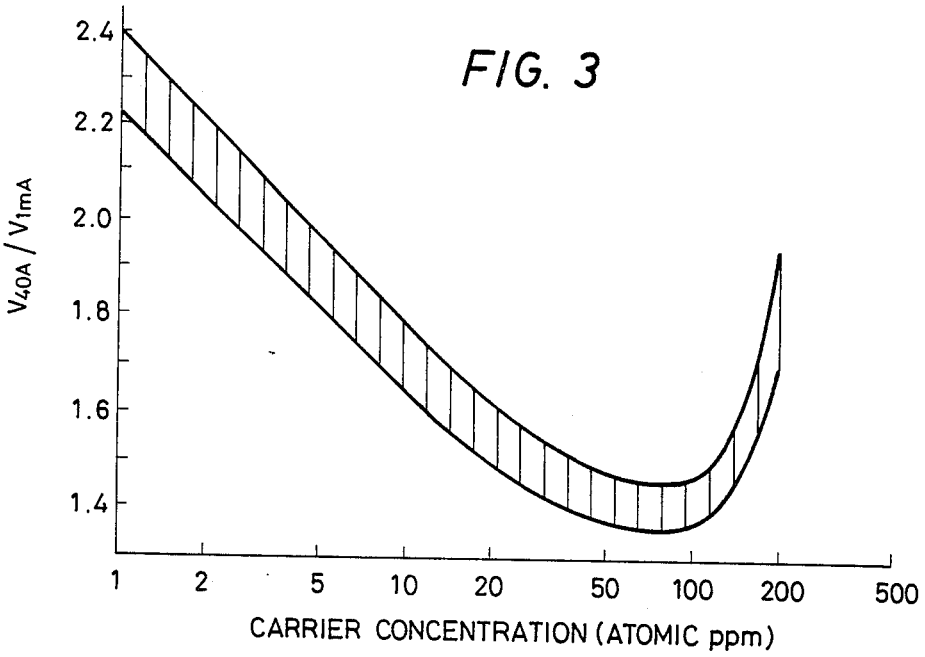
FIG. 3 is a graph showing the carrier concentration and the ratio, V(40 A)/V(1 mA), obtained at the combinations of Li and Al concentrations of Table 1 wherein the Li concentration is in the range of 5 to 1,000 ppm.

FIG. 2 shows the relation between the carrier concentration and the nonlinear voltage coefficient, $\alpha$. FIG. 3 shows the relation between the carrier concentration and the ratio, V(40 A)/V(1 mA). It has been demonstrated by the inventors that the behavior of carrier concentration shown in FIG. 1 represents proper data in the light of the theoretical calculation performed with the aid of model semiconductors containing both a donor and an acceptor.

(Example 2):

The procedure of Example 1 was faithfully repeated, except that Na was added in the place of Li. The results are shown in Table 2. It is noted from the results that the effect of Na was virtually the same as that of Li.

(Example 3):

A model test was carried out by varying the amount of Fe added in the range of 0 to 20 atomic ppm to find the effect of the addition of Fe.

The test will be descrbed in detail below.

From the results of Example 1, a total of 8 combinations of Li and Al which had carrier concentrations of about 50 atomic ppm were selected from these combinations which produced elements with satisfactory properties. To samples of each of the 8 combinations, Fe was added in amounts in the range of 0 to 20 atomic ppm as stepped by the unit of 5 atomic ppm. The samples so prepared were tested for the relations between the amount of Fe added and the quantities V(1 mA), $\alpha$, and V(40 A)/V(1 mA). The results are shown in Table 3.

From Table 3, it is noted that so long as the Li content was not less than 50 atomic ppm, the effect of Fe was substantially nil even when the amount of Fe added was 20 atomic ppm.

(Example 4):

The procedure of Example 1 was faithfully repeated, except that Na was added in the place of Li. The results are shown in Table 4. From the result, it is noted that the effect of Na was virtually the same as that of Li.

Figure 4:
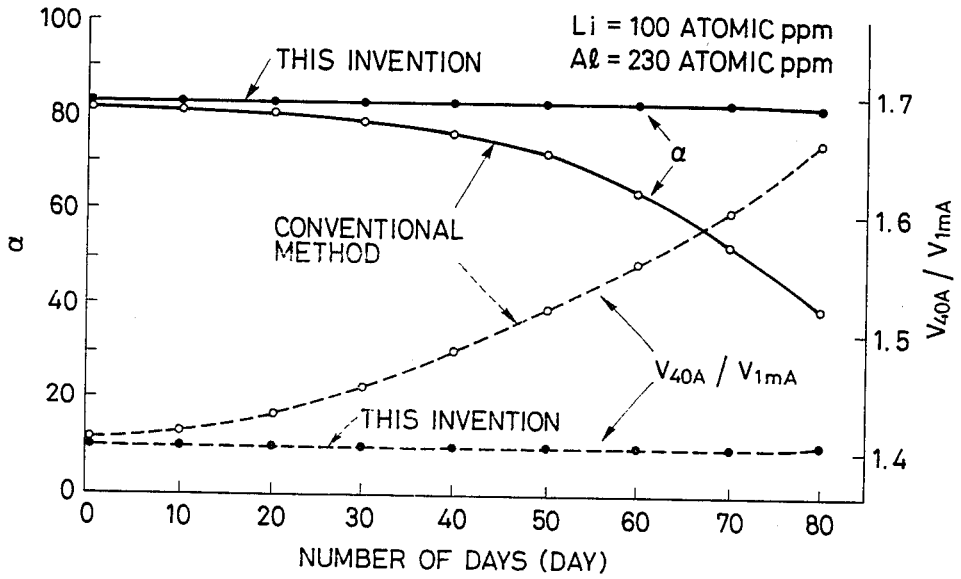
FIG. 4 is a graph showing the relation between the nonlinear voltage coefficient, $\alpha$, and the ratio, V(40 A)/V(1 mA), obtained for varistors formed from raw ZnO material obtained by adding 100 atomic ppm of Li and 230 atomic ppm of Al where the raw ZnO material varies in the number of days after production by the France Method.

(Example 5):

For the purpose of examining the results of the model test of Example 3 on a mass-production scale, ZnO powder lots of varying age (number of days) after their production in the kettle and incorporating therein 100 atomic ppm of Li and 230 atomic ppm of Al were subjected to the same test. The results are shown in FIG. 4. FIG. 4 also shows the results obtained by the conventional method for comparision. It is clearly noted from FIG. 4 that the present invention virtually eliminates the effect of a presumed increase in Fe contamination that occurs with increased usage of the kettle.

Figure 5:
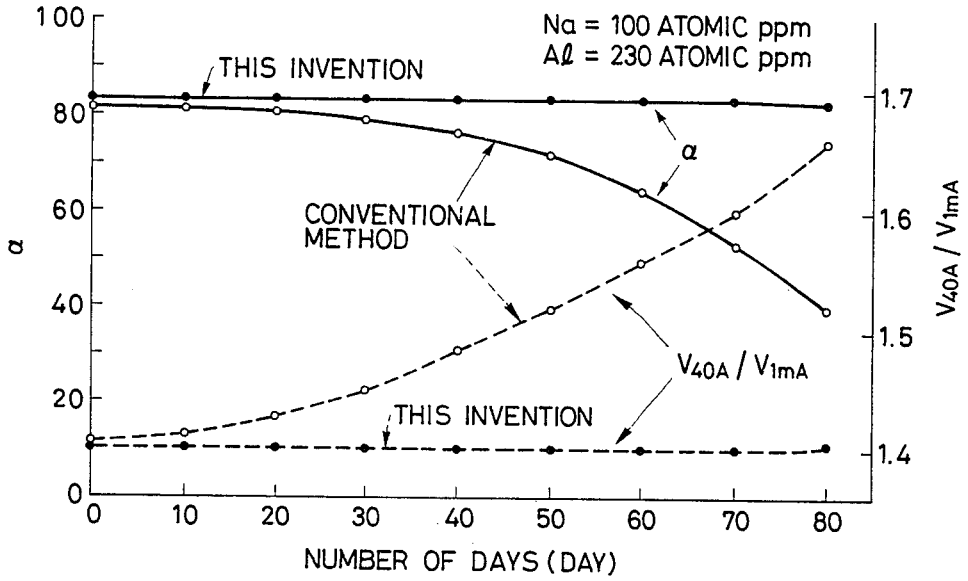
FIG. 5 is a graph showing the relation between the nonlinear voltage coefficient, $\alpha$, and the ratio V(40 A)/V(1 mA), obtained for varistors formed from raw ZnO material obtained by adding 100 atomic ppm of Na and 230 atomic ppm of Al where the raw ZnO material varies in the number of days after production by the France Method.

(Example 6):

For the purpose of examining the results of the model test of Example 4 on a mass-production scale, ZnO powder lots of varying age (number of days) after their production in the kettle and incorporating therein 100 atomic ppm of Na and 230 atomic ppm of Al were subjected to the same test. The results are shown in FIG. 5. FIG. 5 also shows the results obtained by the conventional method for comparison. It is clearly noted from FIG. 5 that the present invention brings about the same neutralizing effect of Fe contamination as was shown in FIG. 4.

In none of the test runs of the present examples were Li and Na added simultaneously. In a separate experiment, it has been demonstrated that the V-I property is virtually constant when Li and Na are simultaneously added in a combined amount equal to the amount of Li or Na to be added independently.

(Example 7):

The procedure of Example 1 was faithfully repeated, except In was added in the place of Al. The results are shown in Table 5. From the results, it is noted that the effect of In was virtually the same as that of Al.

(Example 8):

The procedure of Example 1 was faithfully repeated, except that Ga was added in the place of Al. The results are shown in Table 6. It is noted from the results that the effect of Ga was substantially the same as that of Al.

Figure 6:
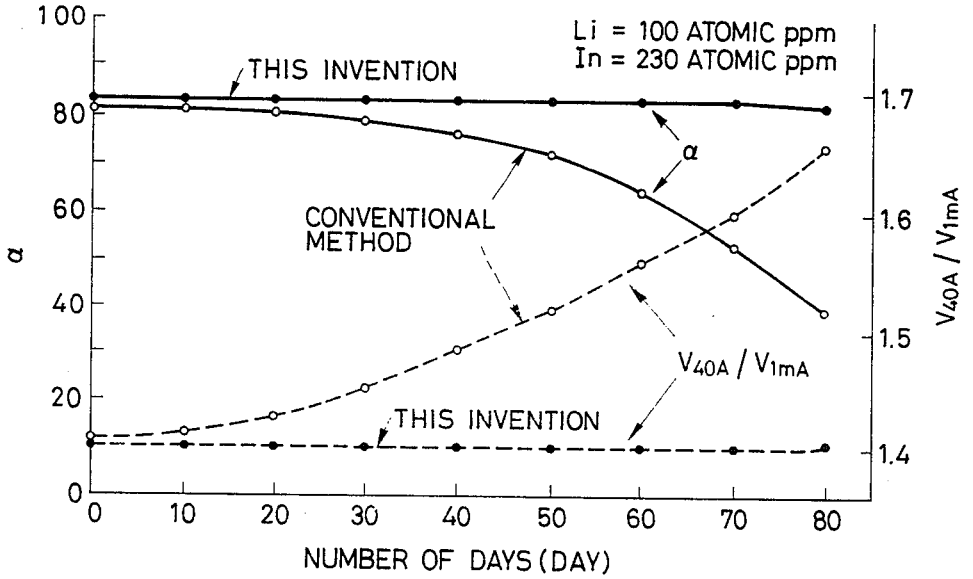
FIG. 6 is a graph showing the relation between the nonlinear voltage coefficient, $\alpha$, and the ratio, V(40

(Example 9):

For the purpose of examining the results of the model test of Example 3 on a mass-production scale, ZnO powder lots of varying ages (number of days) after their production in the kettle and incorporating therein 100 atomic ppm of Li and 230 atomic ppm of In were subjected to the same test. The results are shown in FIG. 6. FIG. 6 also shows the results obtained by the conventional method for comparison. The same effects as exhibited in FIGS. 4 and 5 were achieved.

Figure 7:
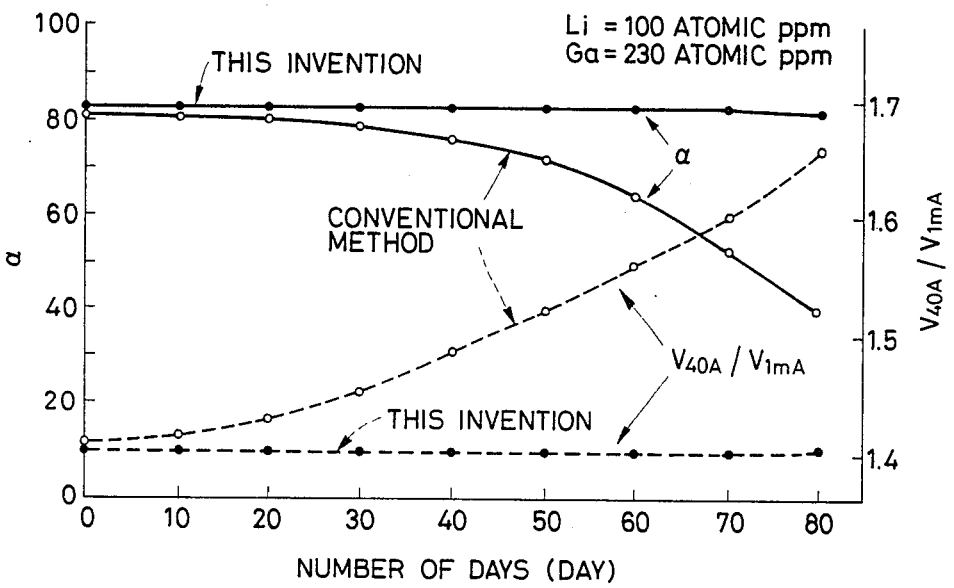
FIG. 7 is a graph showing the relation between the nonlinear voltage coefficient, $\alpha$, and the ratio, V(40 A)/V(1 mA), obtained for varistors formed from raw ZnO material obtained by adding 100 atomic ppm of Li and 230 atomic ppm of Ga where the raw ZnO material varies in the number of days after production by the France Method.

(Example 10):

For the purpose of examinating the results of the model test of Example 3 on a mass-production scale, ZnO powder lots of varying ages (number of days) after their poduction in the kettle and incorporating therein 100 atomic ppm of Li and 230 atomic ppm of Ga were subjected to the same test. The results as shown in FIG. 7 also show the results obtained by the conventional method for comparison. The same effects as exhibited in FIGS. 4, 5, and 6 were achieved.

In none of the test runs of the present examples were In and Ga used in comination with Na. In a separate experiment, it has been demonstrated that the same neutralizing effect is obtained when In and Ga are used in combination with Na.

Al, In, and Ga fulfill substantially the same function. From this fact, it can be easily inferred that the V-I property is virtually constant when these three elements are simultaneously added in a total amount equal to the amount in which they are independently added.

In this example, only the compositions of the raw material based on the invention of Japanese Patent Publication No. SHO 57(1982)-42,962 were used. The effect of this invention is not limited to these compositions. The same effect of the present invention is recognized with the $ZnO-Bi_2O_3$ type ZnO varistor and the ZnO varistor incorporating a rare earth element other than Pr.

In accordance with the present invention, after the effect of the Fe contamination of the ZnO raw material is counteracted by Li or Na, the addition of Al in an amount selected for the carrier concentration to fall in the range of 5 to 120 atomic ppm permits production of a ZnO varistor having properties that are not substantially affected by the amount of Fe intermingled with the ZnO powder.

TABLE 1

| Sample No. | Amount of Li added (atomic ppm) | Amount of Al added (atomic ppm) | V(1 mA) (V) | α | V(40 A)/V(1 mA) |
|---|---|---|---|---|---|
| 1 | 5 | 5 | 499 | 6 | 4.23 |
| 2 | " | 6 | 394 | 21 | 2.21 |
| 3 | " | 10 | 250 | 78 | 1.81 |
| 4 | " | 16 | 211 | 87 | 1.64 |
| 5 | " | 30 | 189 | 91 | 1.55 |
| 6 | " | 90 | 187 | 84 | 1.42 |
| 7 | " | 220 | 192 | 62 | 1.37 |
| 8 | " | 430 | 182 | 32 | 1.65 |
| 9 | " | 700 | 158 | 11 | 1.83 |
| 10 | 10 | 10 | 504 | 7 | 4.23 |
| 11 | " | 11 | 398 | 23 | 2.22 |
| 12 | " | 16 | 252 | 79 | 1.86 |
| 13 | " | 22 | 244 | 86 | 1.61 |
| 14 | " | 35 | 189 | 91 | 1.57 |
| 15 | " | 90 | 189 | 85 | 1.43 |
| 16 | " | 220 | 194 | 64 | 1.37 |
| 17 | " | 430 | 184 | 36 | 1.63 |
| 18 | " | 700 | 160 | 16 | 1.85 |
| 19 | 20 | 20 | 510 | 6 | 4.23 |
| 20 | " | 21 | 402 | 21 | 2.24 |
| 21 | " | 28 | 255 | 78 | 1.82 |
| 22 | " | 36 | 216 | 87 | 1.62 |
| 23 | " | 52 | 191 | 93 | 1.55 |
| 24 | " | 110 | 191 | 81 | 1.42 |
| 25 | " | 250 | 196 | 62 | 1.39 |
| 26 | " | 450 | 186 | 32 | 1.65 |
| 27 | " | 700 | 162 | 12 | 1.85 |
| 28 | 50 | 50 | 515 | 6 | 4.23 |
| 29 | " | 51 | 406 | 20 | 2.23 |
| 30 | " | 80 | 257 | 77 | 1.84 |
| 31 | " | 68 | 213 | 88 | 1.66 |
| 32 | " | 84 | 995 | 93 | 1.57 |
| 33 | " | 150 | 193 | 81 | 1.41 |
| 34 | " | 320 | 198 | 64 | 1.38 |
| 35 | " | 560 | 183 | 34 | 1.63 |
| 36 | " | 900 | 163 | 11 | 1.88 |
| 37 | 100 | 100 | 520 | 5 | 4.20 |
| 38 | " | 102 | 410 | 20 | 2.20 |
| 39 | " | 110 | 260 | 77 | 1.82 |
| 40 | " | 120 | 220 | 88 | 1.62 |
| 41 | " | 140 | 195 | 90 | 1.58 |
| 42 | " | 230 | 195 | 82 | 1.40 |
| 43 | " | 420 | 200 | 63 | 1.38 |
| 44 | " | 700 | 190 | 30 | 1.62 |
| 45 | " | 1100 | 165 | 10 | 1.83 |
| 46 | 200 | 200 | 530 | 5 | 4.24 |
| 47 | " | 202 | 418 | 20 | 2.26 |
| 48 | " | 220 | 265 | 76 | 1.88 |
| 49 | " | 230 | 224 | 85 | 1.66 |
| 50 | " | 260 | 199 | 88 | 1.63 |
| 51 | " | 380 | 198 | 78 | 1.43 |
| 52 | " | 640 | 204 | 59 | 1.41 |

TABLE 1-continued

| Sample No. | Amount of Li added (atomic ppm) | Amount of Al added (atomic ppm) | V(1 mA) (V) | α | V(40 A)/V(1 mA) |
|---|---|---|---|---|---|
| 53 | " | 960 | 194 | 31 | 1.66 |
| 54 | " | 1500 | 168 | 12 | 1.88 |
| 55 | 500 | 500 | 541 | 6 | 4.32 |
| 56 | " | 502 | 424 | 18 | 2.28 |
| 57 | " | 520 | 279 | 72 | 1.88 |
| 58 | " | 580 | 228 | 81 | 1.67 |
| 59 | " | 620 | 202 | 83 | 1.64 |
| 60 | " | 800 | 204 | 78 | 1.44 |
| 61 | " | 1300 | 208 | 62 | 1.42 |
| 62 | " | 1800 | 199 | 29 | 1.67 |
| 63 | " | 2600 | 171 | 9 | 1.91 |
| 64 | 1000 | 1000 | 551 | 6 | 4.49 |
| 65 | " | 1010 | 435 | 18 | 2.42 |
| 66 | " | 1080 | 277 | 63 | 1.89 |
| 67 | " | 1100 | 233 | 78 | 1.71 |
| 68 | " | 1200 | 207 | 80 | 1.69 |
| 69 | " | 1600 | 206 | 72 | 1.51 |
| 70 | " | 2500 | 215 | 61 | 1.45 |
| 71 | " | 3400 | 201 | 20 | 1.73 |
| 72 | " | 4500 | 175 | 8 | 1.98 |
| 73 | 2000 | 2000 | 886 | 4 | 5.62 |
| 74 | " | 2010 | 743 | 11 | 3.39 |
| 75 | " | 2100 | 532 | 11 | 2.18 |
| 76 | " | 2200 | 543 | 12 | 1.93 |
| 77 | " | 2400 | 412 | 10 | 1.93 |
| 78 | " | 3200 | 439 | 12 | 1.92 |
| 79 | " | 5000 | 468 | 13 | 2.04 |
| 80 | " | 7000 | 410 | 8 | 2.18 |
| 81 | " | 9800 | 345 | 5 | 2.83 |

TABLE 2

| Sample No. | Amount of Na added (atomic ppm) | Amount of Al added (atomic ppm) | V(1 mA) (V) | α | V(40 A)/V(1 mA) |
|---|---|---|---|---|---|
| 82 | 5 | 5 | 499 | 6 | 4.23 |
| 83 | " | 6 | 394 | 21 | 2.21 |
| 84 | " | 10 | 250 | 78 | 1.81 |
| 85 | " | 16 | 211 | 87 | 1.64 |
| 86 | " | 30 | 189 | 91 | 1.55 |
| 87 | " | 90 | 187 | 84 | 1.42 |
| 88 | " | 220 | 192 | 62 | 1.37 |
| 89 | " | 430 | 182 | 32 | 1.65 |
| 90 | " | 700 | 158 | 11 | 1.83 |
| 91 | 10 | 10 | 504 | 7 | 4.23 |
| 92 | " | 11 | 398 | 23 | 2.22 |
| 93 | " | 16 | 252 | 79 | 1.86 |
| 94 | " | 22 | 244 | 86 | 1.61 |
| 95 | " | 35 | 189 | 91 | 1.57 |
| 96 | " | 90 | 189 | 85 | 1.43 |
| 97 | " | 220 | 194 | 64 | 1.37 |
| 98 | " | 430 | 184 | 36 | 1.63 |
| 99 | " | 700 | 160 | 16 | 1.85 |
| 100 | 20 | 20 | 510 | 6 | 4.23 |
| 101 | " | 21 | 402 | 21 | 2.24 |
| 102 | " | 28 | 255 | 78 | 1.82 |
| 103 | " | 36 | 216 | 87 | 1.62 |
| 104 | " | 52 | 191 | 93 | 1.55 |
| 105 | " | 110 | 191 | 81 | 1.42 |
| 106 | " | 250 | 196 | 62 | 1.39 |
| 107 | " | 450 | 186 | 32 | 1.65 |
| 108 | " | 700 | 162 | 12 | 1.85 |
| 109 | 50 | 50 | 515 | 6 | 4.23 |
| 110 | " | 51 | 406 | 20 | 2.23 |
| 111 | " | 60 | 257 | 77 | 1.84 |
| 112 | " | 68 | 213 | 88 | 1.66 |
| 113 | " | 84 | 995 | 93 | 1.57 |
| 114 | " | 150 | 193 | 81 | 1.41 |
| 115 | " | 320 | 198 | 64 | 1.38 |
| 116 | " | 560 | 188 | 34 | 1.63 |
| 117 | " | 900 | 163 | 11 | 1.88 |
| 118 | 100 | 100 | 520 | 5 | 4.20 |
| 119 | " | 102 | 410 | 20 | 2.20 |
| 120 | " | 110 | 260 | 77 | 1.82 |
| 121 | " | 120 | 220 | 88 | 1.62 |
| 122 | " | 140 | 195 | 90 | 1.58 |
| 123 | " | 230 | 195 | 82 | 1.40 |

TABLE 2-continued

| Sample No. | Amount of Na added (atomic ppm) | Amount of Al added (atomic ppm) | V(1 mA) (V) | α | V(40 A)/V(1 mA) |
|---|---|---|---|---|---|
| 124 | " | 420 | 200 | 63 | 1.38 |
| 125 | " | 700 | 190 | 30 | 1.62 |
| 126 | " | 1100 | 165 | 10 | 1.83 |
| 127 | 200 | 200 | 530 | 5 | 4.24 |
| 128 | " | 202 | 418 | 20 | 2.26 |
| 129 | " | 220 | 265 | 76 | 1.88 |
| 130 | " | 230 | 224 | 85 | 1.66 |
| 131 | " | 260 | 199 | 88 | 1.63 |
| 132 | " | 380 | 198 | 78 | 1.43 |
| 133 | " | 640 | 204 | 59 | 1.41 |
| 134 | " | 960 | 194 | 31 | 1.66 |
| 135 | " | 1500 | 168 | 12 | 1.88 |
| 136 | 500 | 500 | 541 | 6 | 4.32 |
| 137 | " | 502 | 424 | 18 | 2.28 |
| 138 | " | 520 | 279 | 72 | 1.88 |
| 139 | " | 580 | 228 | 81 | 1.67 |
| 140 | " | 620 | 202 | 83 | 1.64 |
| 141 | " | 800 | 204 | 78 | 1.44 |
| 142 | " | 1300 | 208 | 62 | 1.42 |
| 143 | " | 1800 | 199 | 29 | 1.67 |
| 144 | " | 2600 | 171 | 9 | 1.91 |
| 145 | 1000 | 1000 | 551 | 6 | 4.49 |
| 146 | " | 1010 | 435 | 18 | 2.42 |
| 147 | " | 1080 | 277 | 63 | 1.89 |
| 148 | " | 1100 | 233 | 78 | 1.71 |
| 149 | " | 1200 | 207 | 80 | 1.69 |
| 150 | " | 1600 | 206 | 72 | 1.51 |
| 151 | " | 2500 | 215 | 61 | 1.45 |
| 152 | " | 3400 | 201 | 20 | 1.73 |
| 153 | " | 4500 | 175 | 8 | 1.98 |
| 154 | 2000 | 2000 | 886 | 4 | 5.62 |
| 155 | " | 2010 | 743 | 11 | 3.39 |
| 156 | " | 2100 | 532 | 11 | 2.18 |
| 157 | " | 2200 | 543 | 12 | 1.93 |
| 158 | " | 2400 | 412 | 10 | 1.93 |
| 159 | " | 3200 | 439 | 12 | 1.92 |
| 160 | " | 5000 | 468 | 13 | 2.04 |
| 161 | " | 7000 | 410 | 8 | 2.18 |
| 162 | " | 9800 | 345 | 5 | 2.83 |

TABLE 3

| Sample No. | Li (ppm) | Al (ppm) | Fe (ppm) | V(1 mA) (V) | α | V(40 A)/V(1 mA) |
|---|---|---|---|---|---|---|
| 6 | 5 | 90 | 0 | 187 | 84 | 1.42 |
| 163 | " | " | 5 | 184 | 73 | 1.44 |
| 164 | " | " | 10 | 178 | 58 | 1.49 |
| 165 | " | " | 15 | 173 | 51 | 1.53 |
| 166 | " | " | 20 | 170 | 41 | 1.62 |
| 15 | 10 | 90 | 0 | 189 | 85 | 1.43 |
| 167 | " | " | 5 | 185 | 77 | 1.43 |
| 168 | " | " | 10 | 179 | 69 | 1.48 |
| 169 | " | " | 15 | 174 | 63 | 1.52 |
| 170 | " | " | 20 | 172 | 45 | 1.60 |
| 24 | 20 | 110 | 0 | 191 | 81 | 1.42 |
| 171 | " | " | 5 | 186 | 78 | 1.43 |
| 172 | " | " | 10 | 183 | 72 | 1.48 |
| 173 | " | " | 15 | 181 | 68 | 1.53 |
| 174 | " | " | 20 | 177 | 51 | 1.62 |
| 33 | 50 | 150 | 0 | 193 | 81 | 1.41 |
| 175 | " | " | 5 | 195 | 83 | 1.42 |
| 176 | " | " | 10 | 194 | 82 | 1.41 |
| 177 | " | " | 15 | 194 | 82 | 1.42 |
| 178 | " | " | 20 | 193 | 80 | 1.43 |
| 42 | 100 | 230 | 0 | 195 | 82 | 1.40 |
| 179 | " | " | 5 | 196 | 82 | 1.41 |
| 180 | " | " | 10 | 195 | 82 | 1.41 |
| 181 | " | " | 15 | 195 | 83 | 1.42 |
| 182 | " | " | 20 | 194 | 81 | 1.42 |
| 51 | 200 | 380 | 0 | 198 | 78 | 1.43 |
| 183 | " | " | 5 | 198 | 78 | 1.43 |
| 184 | " | " | 10 | 198 | 78 | 1.43 |
| 185 | " | " | 15 | 199 | 79 | 1.44 |
| 186 | " | " | 20 | 198 | 77 | 1.43 |
| 60 | 500 | 800 | 0 | 204 | 78 | 1.44 |
| 187 | " | " | 5 | 204 | 78 | 1.44 |
| 188 | " | " | 10 | 203 | 77 | 1.44 |

TABLE 3-continued

| Sample No. | Li (ppm) | Al (ppm) | Fe (ppm) | V(1 mA) (V) | α | V(40 A)/V(1 mA) |
|---|---|---|---|---|---|---|
| 189 | " | " | 15 | 203 | 78 | 1.43 |
| 190 | " | " | 20 | 204 | 79 | 1.44 |
| 69 | 1000 | 1600 | 0 | 206 | 72 | 1.51 |
| 191 | " | " | 5 | 206 | 73 | 1.52 |
| 192 | " | " | 10 | 207 | 72 | 1.51 |
| 193 | " | " | 15 | 207 | 71 | 1.51 |
| 194 | " | " | 20 | 207 | 72 | 1.51 |

TABLE 4

| Sample No. | Na (ppm) | Al (ppm) | Fe (ppm) | V(1 mA) (V) | α | V(40 A)/V(1 mA) |
|---|---|---|---|---|---|---|
| 87 | 5 | 90 | 0 | 187 | 84 | 1.42 |
| 195 | " | " | 5 | 184 | 73 | 1.44 |
| 196 | " | " | 10 | 178 | 58 | 1.49 |
| 197 | " | " | 15 | 173 | 51 | 1.53 |
| 198 | " | " | 20 | 170 | 41 | 1.62 |
| 96 | 10 | 90 | 0 | 189 | 85 | 1.43 |
| 199 | " | " | 5 | 185 | 77 | 1.43 |
| 200 | " | " | 10 | 179 | 69 | 1.48 |
| 201 | " | " | 15 | 174 | 63 | 1.52 |
| 202 | " | " | 20 | 172 | 45 | 1.60 |
| 105 | 20 | 110 | 0 | 191 | 81 | 1.42 |
| 203 | " | " | 5 | 186 | 78 | 1.43 |
| 204 | " | " | 10 | 183 | 72 | 1.48 |
| 205 | " | " | 15 | 181 | 68 | 1.53 |
| 206 | " | " | 20 | 177 | 51 | 1.62 |
| 114 | 50 | 150 | 0 | 193 | 81 | 1.41 |
| 207 | " | " | 5 | 195 | 83 | 1.42 |
| 208 | " | " | 10 | 194 | 82 | 1.41 |
| 209 | " | " | 15 | 194 | 82 | 1.42 |
| 210 | " | " | 20 | 193 | 80 | 1.43 |
| 123 | 100 | 230 | 0 | 195 | 82 | 1.40 |
| 211 | " | " | 5 | 196 | 82 | 1.41 |
| 212 | " | " | 10 | 195 | 82 | 1.41 |
| 213 | " | " | 15 | 195 | 83 | 1.42 |
| 214 | " | " | 20 | 194 | 81 | 1.42 |
| 132 | 200 | 380 | 0 | 198 | 78 | 1.43 |
| 215 | " | " | 5 | 198 | 78 | 1.43 |
| 216 | " | " | 10 | 198 | 78 | 1.43 |
| 217 | " | " | 15 | 199 | 79 | 1.44 |
| 218 | " | " | 20 | 198 | 77 | 1.43 |
| 141 | 500 | 800 | 0 | 204 | 78 | 1.44 |
| 219 | " | " | 5 | 204 | 78 | 1.44 |
| 220 | " | " | 10 | 203 | 77 | 1.44 |
| 221 | " | " | 15 | 203 | 78 | 1.43 |
| 222 | " | " | 20 | 204 | 79 | 1.44 |
| 150 | 1000 | 1600 | 0 | 206 | 72 | 1.51 |
| 223 | " | " | 5 | 206 | 73 | 1.52 |
| 224 | " | " | 10 | 207 | 72 | 1.51 |
| 225 | " | " | 15 | 207 | 71 | 1.51 |
| 226 | " | " | 20 | 207 | 72 | 1.51 |

TABLE 5

| Sample No. | Amount of Li added (atomic ppm) | Amount of In added (atomic ppm) | V(1 mA) (V) | α | V(40 A)/V(1 mA) |
|---|---|---|---|---|---|
| 227 | 5 | 5 | 501 | 5 | 4.24 |
| 228 | " | 6 | 396 | 20 | 2.22 |
| 229 | " | 10 | 252 | 77 | 1.82 |
| 230 | " | 16 | 213 | 86 | 1.65 |
| 231 | " | 30 | 191 | 90 | 1.56 |
| 232 | " | 90 | 189 | 83 | 1.43 |
| 233 | " | 220 | 194 | 61 | 1.38 |
| 234 | " | 430 | 184 | 31 | 1.66 |
| 235 | " | 700 | 160 | 10 | 1.84 |
| 236 | 10 | 10 | 506 | 6 | 4.24 |
| 237 | " | 11 | 400 | 22 | 2.23 |
| 238 | " | 16 | 254 | 78 | 1.87 |
| 239 | " | 22 | 246 | 85 | 1.62 |
| 240 | " | 35 | 191 | 90 | 1.58 |
| 241 | " | 90 | 191 | 84 | 1.44 |
| 242 | " | 220 | 196 | 63 | 1.38 |
| 243 | " | 430 | 186 | 35 | 1.64 |
| 244 | " | 700 | 162 | 15 | 1.86 |

TABLE 5-continued

| Sample No. | Amount of Li added (atomic ppm) | Amount of In added (atomic ppm) | V(1 mA) (V) | α | V(40 A)/V(1 mA) |
|---|---|---|---|---|---|
| 245 | 20 | 20 | 511 | 5 | 4.24 |
| 246 | " | 21 | 404 | 20 | 2.25 |
| 247 | " | 28 | 256 | 77 | 1.83 |
| 248 | " | 36 | 217 | 86 | 1.63 |
| 249 | " | 52 | 192 | 92 | 1.56 |
| 250 | " | 110 | 193 | 80 | 1.43 |
| 251 | " | 250 | 197 | 61 | 1.40 |
| 252 | " | 450 | 188 | 31 | 1.66 |
| 253 | " | 700 | 163 | 11 | 1.86 |
| 254 | 50 | 50 | 516 | 5 | 4.24 |
| 255 | " | 51 | 407 | 19 | 2.24 |
| 256 | " | 60 | 258 | 76 | 1.85 |
| 257 | " | 68 | 215 | 87 | 1.67 |
| 258 | " | 84 | 996 | 92 | 1.58 |
| 259 | " | 150 | 195 | 80 | 1.42 |
| 260 | " | 320 | 199 | 63 | 1.39 |
| 261 | " | 560 | 190 | 33 | 1.64 |
| 262 | " | 900 | 165 | 10 | 1.89 |
| 263 | 100 | 100 | 521 | 5 | 4.21 |
| 264 | " | 102 | 412 | 19 | 2.21 |
| 265 | " | 110 | 261 | 76 | 1.83 |
| 266 | " | 120 | 222 | 87 | 1.63 |
| 267 | " | 140 | 197 | 89 | 1.59 |
| 268 | " | 230 | 196 | 81 | 1.41 |
| 269 | " | 420 | 201 | 62 | 1.39 |
| 270 | " | 700 | 192 | 29 | 1.63 |
| 271 | " | 1100 | 167 | 9 | 1.84 |
| 272 | 200 | 200 | 530 | 5 | 4.25 |
| 273 | " | 202 | 419 | 19 | 2.27 |
| 274 | " | 220 | 267 | 75 | 1.89 |
| 275 | " | 230 | 226 | 84 | 1.67 |
| 276 | " | 260 | 201 | 87 | 1.84 |
| 277 | " | 380 | 200 | 77 | 1.44 |
| 278 | " | 640 | 206 | 58 | 1.42 |
| 279 | " | 960 | 195 | 30 | 1.67 |
| 280 | " | 1500 | 169 | 11 | 1.89 |
| 281 | 500 | 500 | 543 | 6 | 4.32 |
| 282 | " | 502 | 426 | 17 | 2.28 |
| 283 | " | 520 | 281 | 71 | 1.88 |
| 284 | " | 580 | 230 | 80 | 1.67 |
| 285 | " | 620 | 204 | 82 | 1.64 |
| 286 | " | 800 | 206 | 77 | 1.45 |
| 287 | " | 1300 | 209 | 61 | 1.43 |
| 288 | " | 1800 | 201 | 28 | 1.68 |
| 289 | " | 2600 | 173 | 9 | 1.92 |
| 290 | 1000 | 1000 | 553 | 6 | 4.50 |
| 291 | " | 1010 | 437 | 17 | 2.43 |
| 292 | " | 1080 | 279 | 62 | 1.90 |
| 293 | " | 1100 | 235 | 77 | 1.72 |
| 294 | " | 1200 | 209 | 79 | 1.70 |
| 295 | " | 1600 | 208 | 71 | 1.52 |
| 296 | " | 2500 | 217 | 60 | 1.46 |
| 297 | " | 3400 | 203 | 19 | 1.74 |
| 298 | " | 4500 | 177 | 8 | 1.99 |
| 299 | 2000 | 2000 | 888 | 4 | 5.63 |
| 300 | " | 2010 | 745 | 11 | 3.40 |
| 301 | " | 2100 | 534 | 11 | 2.19 |
| 302 | " | 2300 | 545 | 12 | 1.94 |
| 303 | " | 2400 | 414 | 10 | 1.94 |
| 034 | " | 3200 | 441 | 12 | 1.93 |
| 305 | " | 5000 | 470 | 13 | 2.05 |
| 306 | " | 7000 | 413 | 8 | 2.10 |
| 307 | " | 9800 | 347 | 5 | 2.84 |

TABLE 6

| Sample No. | Amount of Li added (atomic ppm) | Amount of Ga added (atomic ppm) | V(1 mA) (V) | α | V(40 A)/V(1 mA) |
|---|---|---|---|---|---|
| 308 | 5 | 5 | 502 | 6 | 4.24 |
| 309 | " | 6 | 397 | 20 | 2.23 |
| 310 | " | 10 | 253 | 76 | 1.82 |
| 311 | " | 16 | 214 | 86 | 1.66 |
| 312 | " | 30 | 192 | 89 | 1.56 |
| 313 | " | 90 | 190 | 83 | 1.43 |
| 314 | " | 220 | 195 | 60 | 1.39 |
| 315 | " | 430 | 185 | 31 | 1.68 |

TABLE 6-continued

| Sample No. | Amount of Li added (atomic ppm) | Amount of Ga added (atomic ppm) | V(1 mA) (V) | α | V(40 A)/V(1 mA) |
|---|---|---|---|---|---|
| 316 | " | 700 | 161 | 10 | 1.85 |
| 317 | 10 | 10 | 507 | 7 | 4.24 |
| 318 | " | 11 | 401 | 22 | 2.24 |
| 319 | " | 16 | 255 | 77 | 1.87 |
| 321 | " | 22 | 247 | 85 | 1.63 |
| 321 | " | 35 | 192 | 89 | 1.58 |
| 322 | " | 90 | 192 | 84 | 1.45 |
| 323 | " | 220 | 197 | 62 | 1.38 |
| 324 | " | 430 | 187 | 35 | 1.64 |
| 325 | " | 700 | 163 | 14 | 1.87 |
| 326 | 20 | 20 | 513 | 6 | 4.25 |
| 327 | " | 21 | 405 | 20 | 2.25 |
| 328 | " | 28 | 258 | 76 | 1.84 |
| 329 | " | 36 | 219 | 86 | 1.63 |
| 330 | " | 52 | 194 | 91 | 1.57 |
| 331 | " | 110 | 194 | 79 | 1.43 |
| 332 | " | 250 | 199 | 61 | 1.41 |
| 333 | " | 450 | 189 | 30 | 1.66 |
| 334 | " | 700 | 165 | 11 | 1.87 |
| 335 | 50 | 50 | 518 | 6 | 4.25 |
| 336 | " | 51 | 409 | 19 | 2.24 |
| 337 | " | 60 | 260 | 75 | 1.85 |
| 338 | " | 68 | 217 | 87 | 1.68 |
| 339 | " | 84 | 998 | 91 | 1.58 |
| 340 | " | 150 | 196 | 80 | 1.43 |
| 341 | " | 320 | 201 | 62 | 1.39 |
| 342 | " | 560 | 191 | 33 | 1.65 |
| 343 | " | 900 | 166 | 10 | 1.90 |
| 344 | 100 | 100 | 523 | 5 | 4.24 |
| 345 | " | 102 | 413 | 19 | 2.22 |
| 346 | " | 110 | 263 | 75 | 1.83 |
| 347 | " | 120 | 223 | 87 | 1.61 |
| 348 | " | 140 | 198 | 88 | 1.59 |
| 349 | " | 230 | 198 | 81 | 1.42 |
| 350 | " | 420 | 203 | 61 | 1.39 |
| 351 | " | 700 | 193 | 29 | 1.64 |
| 352 | " | 1100 | 168 | 10 | 1.85 |
| 353 | 200 | 200 | 533 | 5 | 4.25 |
| 354 | " | 202 | 421 | 19 | 2.28 |
| 355 | " | 220 | 268 | 74 | 1.90 |
| 356 | " | 230 | 227 | 84 | 1.67 |
| 357 | " | 260 | 202 | 86 | 1.64 |
| 358 | " | 380 | 201 | 77 | 1.44 |
| 359 | " | 640 | 207 | 57 | 1.43 |
| 360 | " | 960 | 197 | 30 | 1.68 |
| 361 | " | 1500 | 171 | 10 | 1.90 |
| 362 | 500 | 500 | 544 | 6 | 4.34 |
| 363 | " | 502 | 427 | 17 | 2.29 |
| 364 | " | 520 | 282 | 70 | 1.90 |
| 365 | " | 580 | 231 | 80 | 1.69 |
| 366 | " | 620 | 205 | 81 | 1.65 |
| 367 | " | 800 | 207 | 77 | 1.45 |
| 368 | " | 1300 | 211 | 60 | 1.43 |
| 369 | " | 1800 | 202 | 28 | 1.69 |
| 370 | " | 2600 | 174 | 9 | 1.93 |
| 371 | 1000 | 1000 | 554 | 6 | 4.51 |
| 372 | " | 1010 | 438 | 17 | 2.44 |
| 373 | " | 1080 | 280 | 61 | 1.91 |
| 374 | " | 1100 | 236 | 76 | 1.72 |
| 375 | " | 1200 | 210 | 79 | 1.71 |
| 376 | " | 1600 | 209 | 70 | 1.53 |
| 377 | " | 2500 | 218 | 60 | 1.46 |
| 378 | " | 3400 | 241 | 18 | 1.75 |
| 379 | " | 4500 | 178 | 8 | 2.01 |
| 380 | 2000 | 2000 | 889 | 4 | 5.64 |
| 381 | " | 2010 | 746 | 10 | 3.41 |

TABLE 6-continued

| Sample No. | Amount of Li added (atomic ppm) | Amount of Ga added (atomic ppm) | V(1 mA) (V) | α | V(40 A)/V(1 mA) |
|---|---|---|---|---|---|
| 382 | " | 2100 | 535 | 11 | 2.20 |
| 383 | " | 2200 | 548 | 12 | 1.95 |
| 384 | " | 2400 | 415 | 10 | 1.94 |
| 385 | " | 3200 | 442 | 11 | 1.93 |
| 386 | " | 5000 | 471 | 12 | 2.06 |
| 387 | " | 7000 | 413 | 8 | 2.19 |
| 388 | " | 9800 | 348 | 5 | 2.85 |

What is claimed is:

1. A nonlinear voltage resistor comprising a sintered article exhibiting a nonlinear voltage drop over a range of currents passing therethrough, said article being formed of a sintered powder predominantly comprising zinc oxide and including a first element selected from the group of Li and Na and a second element selected from the group of Al, In, and Ga.

2. The nonlinear voltage resistor according to claim 1, wherein said powder contains 50 atomic ppm to 1,000 atomic ppm of said first element.

3. The nonlinear voltage resistor according to claim 2, wherein said powder contains said second element in a proportion sufficient to set the carrier concentration thereof in the range of 5 atomic ppm to 120 atomic ppm.

4. The nonlinear voltage resistor according to claim 1, wherein said powder contains said second element in a proportion sufficient to set the carrier concentration thereof in the range of 5 atomic ppm to 120 atomic ppm.

5. The nonlinear voltage resistor according to claim 1, wherein said first element is Na.

6. The nonlinear voltage resistor according to claim 1, wherein said second element is selected from the group of Al and Ga.

7. The nonlinear voltage resistor according to claim 1, wherein said resistor is adapted to include electrodes baked to the opposite sides of the sintered article.

8. A method for producing a voltage resistor having a nonlinear voltage drop over a range of currents passing therethrough comprising the steps of:

providing a powder primarily comprising ZnO and including a first element selected from the group of Li and Na and a second element selected from the group of Al, In, and Ga;

forming a resistor body from said powder; and sintering said resistor body.

9. The method according to claim 8, further comprising the step of baking electrodes to the opposite sides of the sintered body.

10. A nonlinear voltage resistance ceramic product comprising a sintered article exhibiting a nonlinear voltage drop over a range of currents passing therethrough, said article being formed of a sintered powder predominantly comprising zinc oxide and including a first element selected from the group of Li and Na and a second element selected from the group of Al and Ga.

11. A nonlinear voltage resistance ceramic product comprising a sintered article exhibiting a nonlinear voltage drop over a range of currents passing therethrough, said article being formed of a sintered powder predominantly comprising zinc oxide and including Na and In.

* * * * *